US010988884B2

(12) United States Patent
Kwak et al.

(10) Patent No.: US 10,988,884 B2
(45) Date of Patent: Apr. 27, 2021

(54) CLOTHES TREATING APPARATUS

(71) Applicant: LG ELECTRONICS INC., Seoul (KR)

(72) Inventors: Byeongheon Kwak, Seoul (KR); Jinwoong Kim, Seoul (KR); Hyunseok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

(21) Appl. No.: 15/660,545

(22) Filed: Jul. 26, 2017

(65) Prior Publication Data

US 2018/0038034 A1 Feb. 8, 2018

(30) Foreign Application Priority Data

Aug. 4, 2016 (KR) ..... 10-2016-0099576

(51) Int. Cl.

| | |
|---|---|
| ***D06F 37/22*** | (2006.01) |
| ***D06F 37/24*** | (2006.01) |
| ***D06F 37/06*** | (2006.01) |
| ***D06F 39/04*** | (2006.01) |
| ***D06F 39/08*** | (2006.01) |

(Continued)

(52) U.S. Cl.

CPC ..... *D06F 37/22* (2013.01); *D06F 37/06* (2013.01); *D06F 37/225* (2013.01); *D06F 37/245* (2013.01); *D06F 39/04* (2013.01); *D06F 39/085* (2013.01); *D06F 39/10* (2013.01); *D06F 37/04* (2013.01); *D06F 37/12* (2013.01)

(58) Field of Classification Search

CPC ..... D06F 37/22; D06F 37/225; D06F 37/24; D06F 37/245; D06F 2222/00; D06F 33/30; D06F 33/44; D06F 33/48–76; D06F 34/06; D06F 34/08; D06F 34/16; D06F 2103/38; D06F 2105/56

See application file for complete search history.

(56) References Cited

U.S. PATENT DOCUMENTS

2009/0293551 A1 12/2009 Lee et al.
2010/0326141 A1* 12/2010 Chung ..... D06F 23/04 68/23.2
2011/0094270 A1* 4/2011 Hong ..... D06F 37/225 68/23.2

FOREIGN PATENT DOCUMENTS

CN 2536625 2/2003
CN 2698829 5/2005

(Continued)

OTHER PUBLICATIONS

International Search Report dated Sep. 7, 2017 issued in Application No. PCT/KR2017/005277.

(Continued)

*Primary Examiner* — David G Cormier
(74) *Attorney, Agent, or Firm* — KED & Associates, LLP

(57) ABSTRACT

A clothes treating apparatus is provided. The clothes treating apparatus may include a drum having a locking tab formed by cutting a portion of an outer circumferential surface to be bendable inward towards an interior of the drum, and a balancer having a fastener that protrudes from the outer circumferential surface to hold the locking tab. The locking tab may be configured to be pushed inward towards the interior of the drum in order to be locked in the fastener and to restrict movement of the balancer in a forward or backward direction of the drum as the drum rotates.

18 Claims, 15 Drawing Sheets

(51) Int. Cl.

| | |
|---|---|
| ***D06F 39/10*** | (2006.01) |
| *D06F 37/04* | (2006.01) |
| *D06F 37/12* | (2006.01) |

(56) References Cited

FOREIGN PATENT DOCUMENTS

| | | |
|---|---|---|
| CN | 101581022 | 11/2009 |
| DE | 102009021327 | 11/2009 |
| DE | 102013221293 | 4/2015 |
| EP | 2 578 738 | 4/2013 |
| JP | S51-101070 | 8/1976 |
| JP | 2001-321592 | 11/2001 |
| JP | 2009-033748 | 2/2009 |
| KR | 20-1997-0049648 | 8/1997 |
| KR | 20-1999-0011168 | 3/1999 |
| KR | 10-2014-0002585 | 1/2014 |
| KR | 10-2015-0001636 | 1/2015 |

OTHER PUBLICATIONS

Extended European Search Report dated Oct. 11, 2017 issued in Application No. 17183551.5.
Chinese Office Action dated May 27, 2019 issued in Application No. 201710660372.0 (English translation attached).
Japanese Office Action dated Feb. 25, 2020 issued in JP Application No. 2019-505421.

* cited by examiner

CLOTHES TREATING APPARATUS

CROSS-REFERENCE TO RELATED APPLICATION

This application claims priority under 35 U.S.C. § 119 to Korean Application No. 10-2016-0099576 filed on Aug. 4, 2016, whose entire disclosure is incorporated herein by reference.

BACKGROUND

1. Field

A clothes treating apparatus in which a balancer and a drum may be coupled to each other is provided.

2. Background

A clothes treating apparatus may be an apparatus that removes contaminants from laundry by putting laundry such as, e.g., clothes and bedding, into a drum. The clothes treating apparatus may perform processes, such as, e.g., washing, rinsing, dewatering, and drying. Such clothes treating apparatuses may be classified as a top loading type washing machine or a front loading type washing machine based on a method of loading laundry into the drum. A front loading type washing machine may be called a drum type washing machine.

The clothes treating apparatus may include a cabinet forming an outer appearance, a tub accommodated in the cabinet, a drum rotatably mounted in the tub and having laundry introduced therein, a lifter located on an inner circumferential surface of the drum to help wash the laundry by lifting and dropping the laundry, and a detergent supply device to supply detergent into the drum. Laundry may be accommodated in the drum, and the drum may be rotated by a driving motor to perform washing.

When the laundry is stored in the drum and a distribution of mass of the laundry is within a permissible range around a rotating shaft of the drum, a dynamic equilibrium or dynamic balance may be maintained. However, the drum may be rotated without maintaining the dynamic balance depending on positions of the laundry stored in the drum. When mass distribution of the laundry is not constant during the rotation of the drum, the dynamic balance may be off. Accordingly, vibration and noise may be generated due to the rotation of the drum, and out of the drum such as, e.g., to the tub or the cabinet.

In order to reduce noise and vibration due to the rotation of the drum in a dynamic imbalanced state, balancers may be respectively provided on front and rear sides of the drum. A material having a predetermined weight may be contained in each balancer. The material may be movable along a circumferential direction. When a load inside the drum is to one side, the material may be distributed to an opposite side to a portion where the load is based, thereby preventing an eccentric rotation of the drum.

The balancers may be fixed to the drum. In order to fix the balancers on the front and rear sides of the drum, holes to couple the balancers using screws may be formed at predetermined intervals on an outer circumferential surface of the drum. Balancers may then be attached to the drum by inserting screws into screw mounts formed on outer circumferential surfaces of the balancers.

An operator of a production line may form the holes on the outer circumferential surface of the drum, and may fix the balancers to the drum by using screws that match a number of the screw mounts. However, this method may require a long period of time in order to couple or insert these separate screws, which may increase time required for such coupling tasks and may lower productivity.

BRIEF DESCRIPTION OF THE DRAWINGS

The embodiments will be described in detail with reference to the following drawings in which like reference numerals refer to like elements wherein.

DETAILED DESCRIPTION

Figure 1:
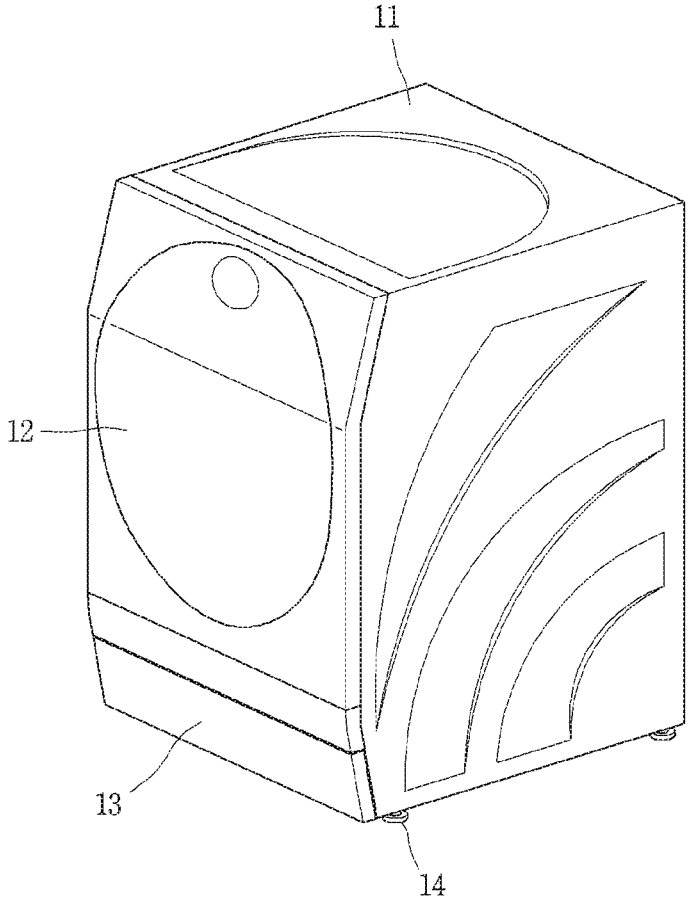
FIG. 1 is a perspective view of an outer appearance of a clothes treating apparatus.
Figure 2:
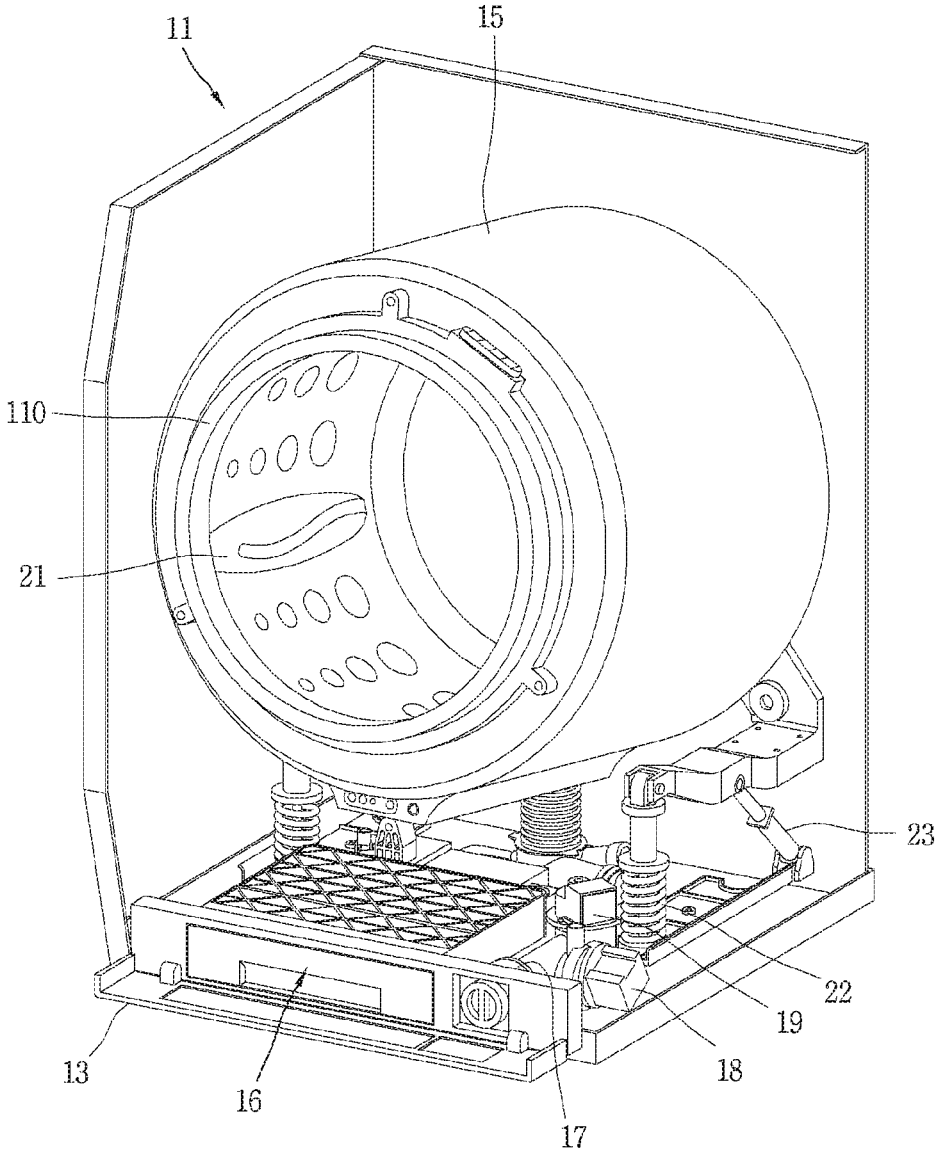
FIG. 2 is a perspective view of an inner structure of the clothes treating apparatus of FIG. 1.

FIG. 1 illustrates an outer appearance of a front-loading type clothes treating apparatus, and FIG. 2 illustrates an inner appearance of the clothes treating apparatus in FIG. 1. The clothes treating apparatus may include a cabinet 11 forming an outer appearance, a drum 110 rotatably mounted in the cabinet 11 and receiving laundry introduced therein, a lifter 21 installed inside the drum 20, a door 12 installed on a front surface of the cabinet 11, and at least one leg 14 to support the cabinet 11. A cover 13 that covers an opening for detergent may be provided on a lower portion of the cabinet 11. The clothes treating apparatus may include a duct, and a heat exchanger so air may be circulated to dry the laundry placed in the drum 20. A base that forms a bottom surface of the cabinet 11 may be located on a lower portion of the clothes processing apparatus. The base may support the drum 110, a tub 15, a drain pump 18, a filter 17, and a detergent supply.

The clothes treating apparatus 100 may be provided in a lower portion thereof with a storage container 16 to accommodate detergent or liquid softener therein and may be drawn out of the cabinet 11, a plurality of elastic members or springs 22 and/or dampers 23 to support the drum 110 and suppress vibration, and a driving motor to rotate the drum 110. The door 12 may be provided on the front surface of the cabinet 11 so that laundry to be washed may be taken in and out. The door 12 may be configured to open and close the front surface of the drum 110. The door 12 may have a disk shape. An electric heater to heat water when power is applied thereto may be provided below the drum 110.

A drain pump 18 to drain water inside the drum 110 may be provided below the drum 110. A circulation pump 19 to pump water within the drum 110 to be introduced into an upper region of the drum 110 may be provided below the drum 110. A filter unit or filter 17 to collect or filter foreign materials from the water drawn out of the drum 110 may be provided at one side of the drain pump 18.

A base may be located at a lower portion of the clothes treating apparatus 100. The base may be provided thereon with the filter unit 17, the drain pump 18, the circulation pump 19, and the elastic members 22 and may form a bottom surface of the clothes treating apparatus 100. The base may be provided with a plurality of legs 14 to place the clothes treating apparatus 100 apart from or above the ground by a predetermined height. The legs 14 may support the clothes treating apparatus 100.

Figure 3:
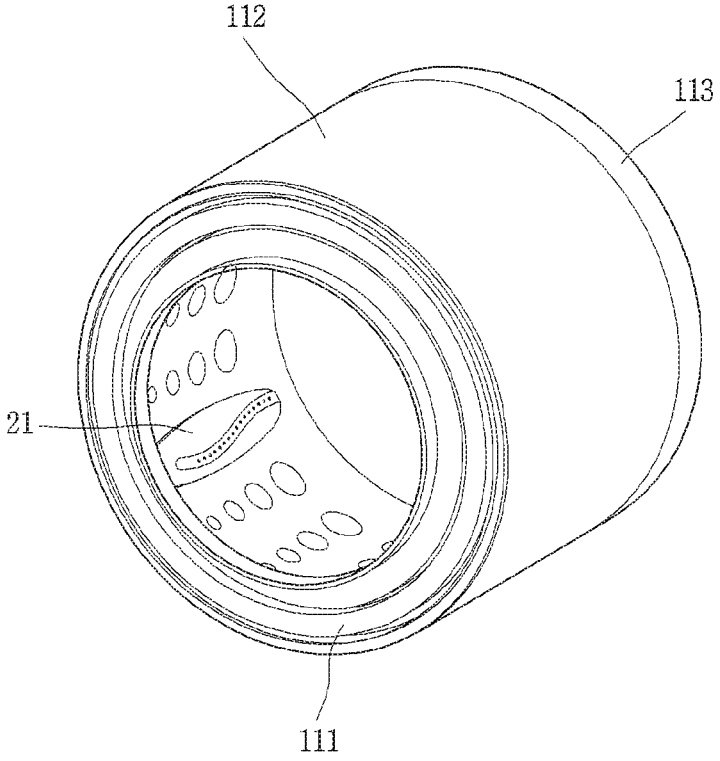
FIG. 3 is a perspective view of a drum within the clothes treating apparatus.
Figure 4:
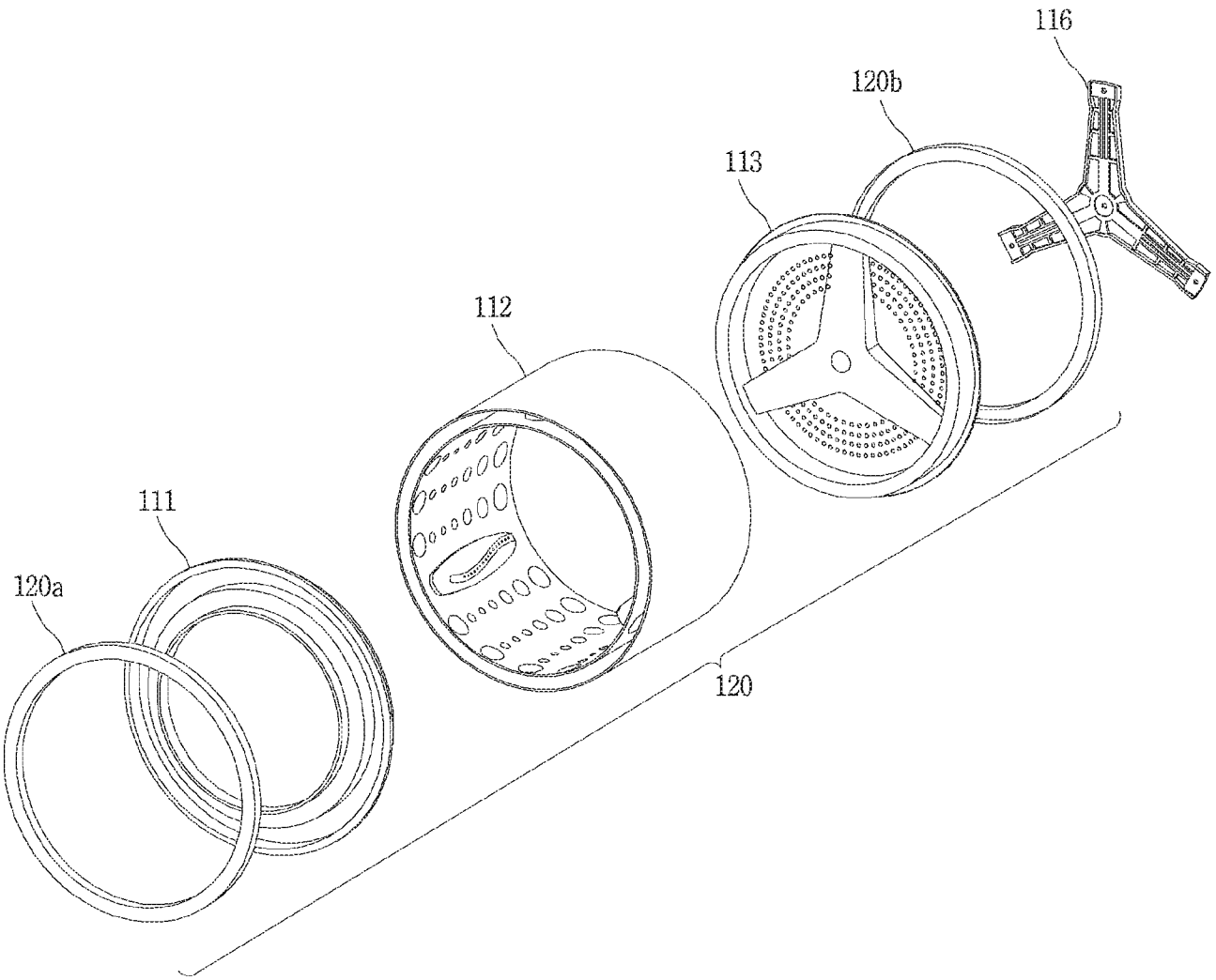
FIG. 4 is an exploded view of the drum of FIG. 3.

Referring to FIG. 3 and FIG. 4, the drum 110 may be formed by coupling a front member or a drum front 111, a drum cylinder or drum middle 112, and a rear member or drum rear 113. The drum 110 may receive laundry therein, and be rotated by the driving motor within the tub to perform a washing process. The outer appearance of the drum 110 may be defined by the front member 111, the drum cylinder 112, and the rear member 113 being coupled together.

A front or first balancer 120*a* and a rear or second balancer 120*b* may be located at front and rear sides of the drum cylinder 112, respectively. A spider 116 may be located at a rear surface of the rear member 113. The first balancer 120*a* and the second balancer 120*b* may suppress vibration as the drum 110 rotates, and may be provided therein with balls or fluid. The spider 116 may allow a rotational force to be applied to the drum 110. The lifter 21 may lift the laundry within the drum 110 and then drop the laundry.

Figure 5:
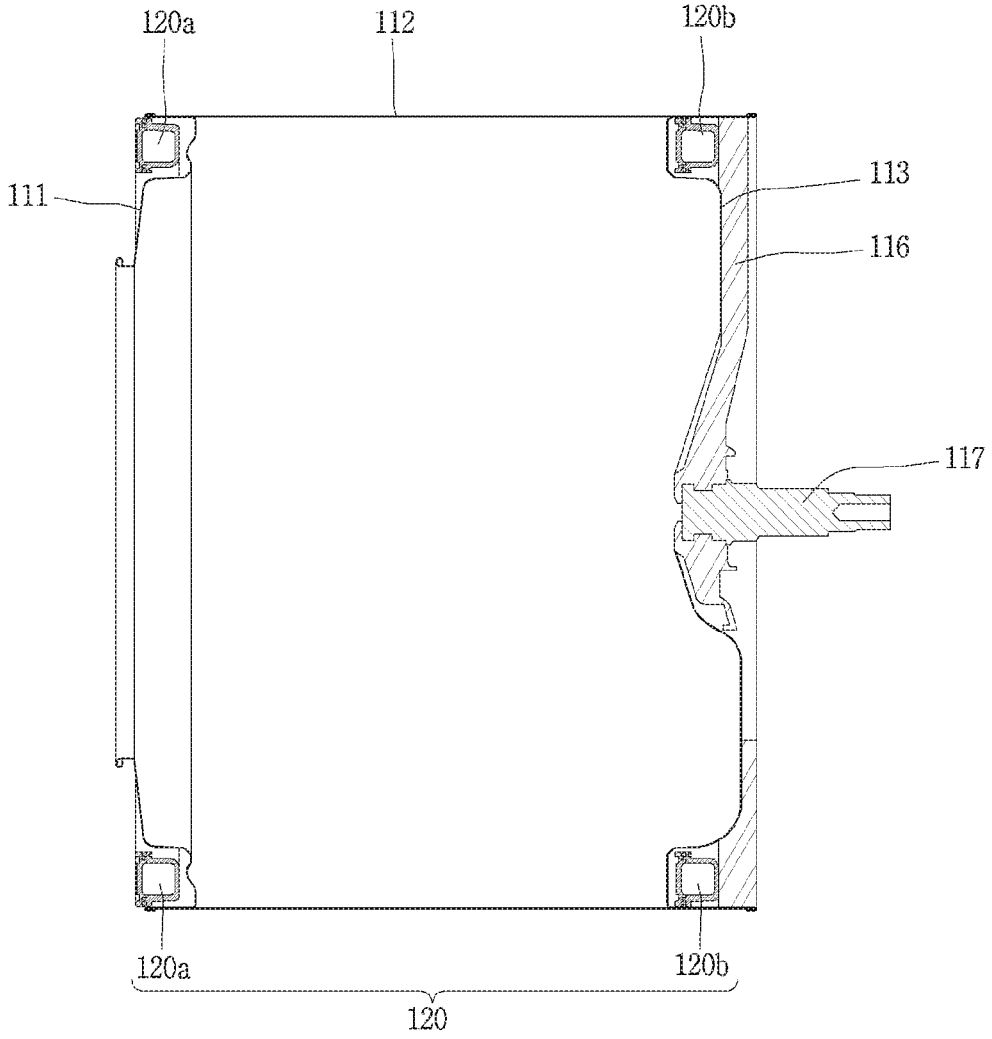
FIG. 5 is a sectional view of a drum and balancers located on front and rear sides of the drum.

Referring to FIG. 5, the drum 110 may include a drum cylinder or cylinder 112 formed in a cylindrical shape, a front member 111 provided on a front side of the drum cylinder 112, a rear member 113 provided on a rear side of the drum cylinder 112.

The front member 111 may be formed in a manner such that a circumferential surface thereof may partially overlap a part of a front circumferential surface of the drum cylinder 112 and then may be connected together with the part of the drum cylinder 112 to be fixed to the drum cylinder 112. The front member 111 may be provided with an opening through which the laundry may be taken in and out.

The front member 111 may protrude forward to form a stepped portion or a recess. The first balancer 120*a* may be mounted on the stepped portion. As illustrated in FIG. 5, the first balancer 120*a* may be formed in a ring shape with a rectangular cross section and provided along a circumference of the front member 110.

Hook accommodating portions or fasteners 121 and screw-coupling portions or screw mounts 122 may be alternately formed at predetermined intervals along an outer circumferential surface of the first balancer 120*a*. Overlapped portions of the front member 111 and the drum cylinder 112 may be attached by hook portions or locking plates or tabs 114, each of which may be formed be cutting, and screwed by screws inserted into holes 115 formed through an outer circumferential surface of the drum 110. As a result, the first balancer 120*a* and the drum 110 may be fixed to each other.

The rear member 113, similar to the front member 111, may be formed in a manner such that a circumferential surface thereof may partially overlap a part of a rear circumferential surface of the drum cylinder 112 and may be connected together with the part of the drum cylinder 112 to be fixed to the drum cylinder 112. The rear member 113, which may cover the rear of the drum cylinder 112, may be provided at the rear of the drum cylinder 112. The spider 116 coupled to a rotating shaft 117 may be coupled to a rear surface of the rear member 113 and may transfer rotational force by the driving motor to the drum 110 through the rotating shaft 117. The rear member 113 may protrude backward to form a stepped portion. The rear balancer 120*b* may be mounted on the stepped portion. Similar to the first balancer 120*a*, the second balancer 120*b* may be formed in a ring shape with a rectangular cross section and provided along a circumference of the rear member 113.

The fasteners 121 and the screw mounts 122 may be alternately formed at predetermined intervals along the outer circumferential surface of the second balancer 120*b*. Overlapped portions of the rear member 113 and the drum cylinder 112 may be hooked or locked by the locking tabs 114, which may be formed via cutting, and coupled via screws through the holes 115 formed through the outer circumferential surface of the drum 110. As a result, the second balancer 120*b* and the drum 110 may be fixed to each other.

Figure 6:
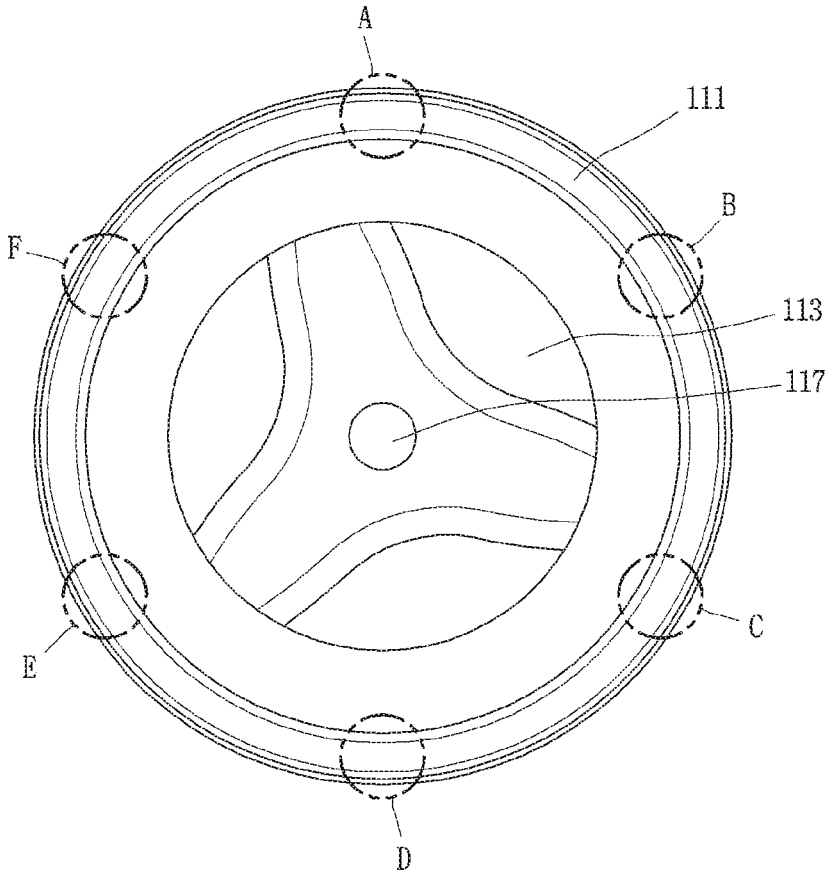
FIG. 6 is a front view of the drum to show a position where lock coupling or screw coupling may be made.

FIG. 6 is a front view of the drum 110 viewed from the front. Positions A to F indicated in FIG. 6 denote coupling positions between the drum 110 and balancer 120 (or first balancer 120*a* and/or second balancer 120*b*) and may be located at 60-degree or equidistant intervals with respect to the circular drum 110. For example, a plurality of locking tabs 114 may be coupled to respective plurality of fasteners 121 at locations equidistant to each other along the outer circumference of the drum 110. However, more coupling positions may be formed to increase coupling force between the drum 110 and the balancer 120, and the embodiments are not limited to a number or locations of the coupling positions illustrated in FIG. 6.

The clothes treating apparatus 100 according to the present disclosure may be characterized by the coupling of the drum 110 and the balancer 120 made alternately via screw coupling and lock coupling. For example, the screw coupling may be made at the positions A and D and the lock coupling may be made at the positions B, C, E and F. Since the lock coupling may be performed more easily than the screw coupling, the lock coupling may be made at at least one of the positions A to F.

The present disclosure may implement various embodiments with a configuration allowing screw coupling or/and lock coupling. However, since unexpected stress may be generated due to centrifugal force or vibration generated by the rotation of the drum 110, each lock coupling may be performed at symmetrical positions with respect to a center of the drum 110, and each screw coupling may also be performed at symmetrical positions with respect to the center of the drum 110.

For coupling the drum 110 and the balancer 120 via lock coupling, a part of the outer circumferential surface of the drum 110 may be cut and the cut part of the drum 110 may be bent toward an inside of the drum 110, thereby forming a locking tab 114 (such as, e.g., a hook, latch, or lock). The fastener 114 may be accommodated in the fastener 121 formed on the outer circumferential surface of the balancer 120 so that the drum 110 and the balancer 120 may be fixed to each other.

For coupling the drum 110 and the balancer 120 via screw-coupling or screws, a hole 115 may be formed through the outer circumferential surface of the drum 110, and a screw mount 122 may be formed on the outer circumferential surface of the balancer 120. A screw may be inserted through the hole 115 of the drum 110 to be coupled into the screw mount 122 of the ball balancer 120, thereby fixing the drum 110 and the balancer 120 to each other.

Figure 7:
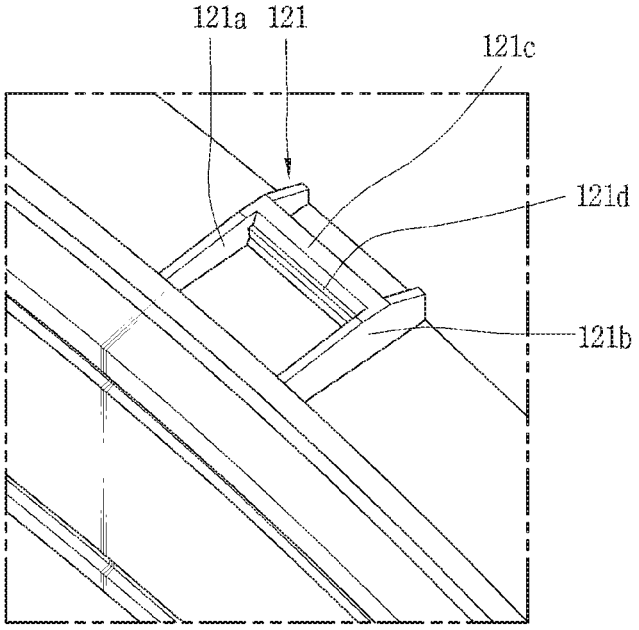
FIG. 7 is a perspective view of a fastener of the balancer.

Referring to FIG. 7, the first balancer 120*a* and the second balancer 120*b* may be provided with the fastener 121, which may protrude along the outer circumferential surface 123 of the first balancer 120*a* and/or the second balancer 120*b*. At least one fastener 121 may be provided on the outer circumferential surface of the first balancer 120*a* and/or the second balancer 120*b*.

The fastener 121 may accommodate the locking tab 114, which may be formed by cutting a portion of the outer circumferential surface of the drum 110 and bending the cut portion into the drum 110. As the locking tab 114 is accommodated in the fastener 121, the drum 110 and the balancer 120 may be fixed to each other. The locking tab 114 may be supported or fastened by the fastener 121 so that the drum 110 and the first balancer 120*a* and/or the second balancer 120*b* may be closely adhered to each other and a back-and-forth movement of the first balancer 120*a* and/or the second balancer 120*b* due to the rotation of the drum may be restricted. An inside of the fastener 121 may have a tapered shape so that the locking tab 114, which may be bent by an external force, may be inserted into the fastener 121 and fastened.

The fastener 121 may include a first portion or wall 121*a*, a second portion or wall 121*b*, a third portion or wall 121*c*, and a stop or notch 121*d*. The first portion 121*a* and the second portion 121*b* may be spaced apart from each other by a predetermined distance. The first portion 121*a* and the second portion 121*b* may protrude from the outer circumferential surface of the balancer 120 and extend in a direction parallel to the rotating shaft 117 of the drum 110.

The spaced distance between the first portion 121*a* and the second portion 121*b* may be determined by a cut width of the outer circumferential surface of the drum 110. The first portion 121*a* and the second portion 121*b* may have a shape with a bent portion, in which a height thereof may protrude from the outer circumferential surface of the balancer 120 and may gradually increase up to where the first portion 121*a* and the second portion 121*b* contact with the third portion 121*c*, which may connect the first portion 121*a* and the second portion 121*b*.

The third portion 121*c* may connect the first portion 121*a* and the second portion 121*b* to each other and may have a shape that protrudes from the outer circumferential surface of the balancer 120. The third portion 121*c* may protrude from the outer circumferential surface of the balancer 120 in a direction intersecting with the extension direction of the first portion 121*a* and the second portion 121*b*.

The third portion 121*c* may be provided with a stop 121*d* on which the locking tab 114 may be locked, hooked, or stopped. The stop 121*d* may be a protrusion formed by a slit or a notch, which extends in one direction on a central portion of the third portion 121*c*. The stop 121*d* may accommodate the locking tab 114 so as to prevent a separation of the locking tab 114, thereby preventing a back-and-forth movement of the balancer 120 due to the rotation of the drum 110.

Figure 8A:
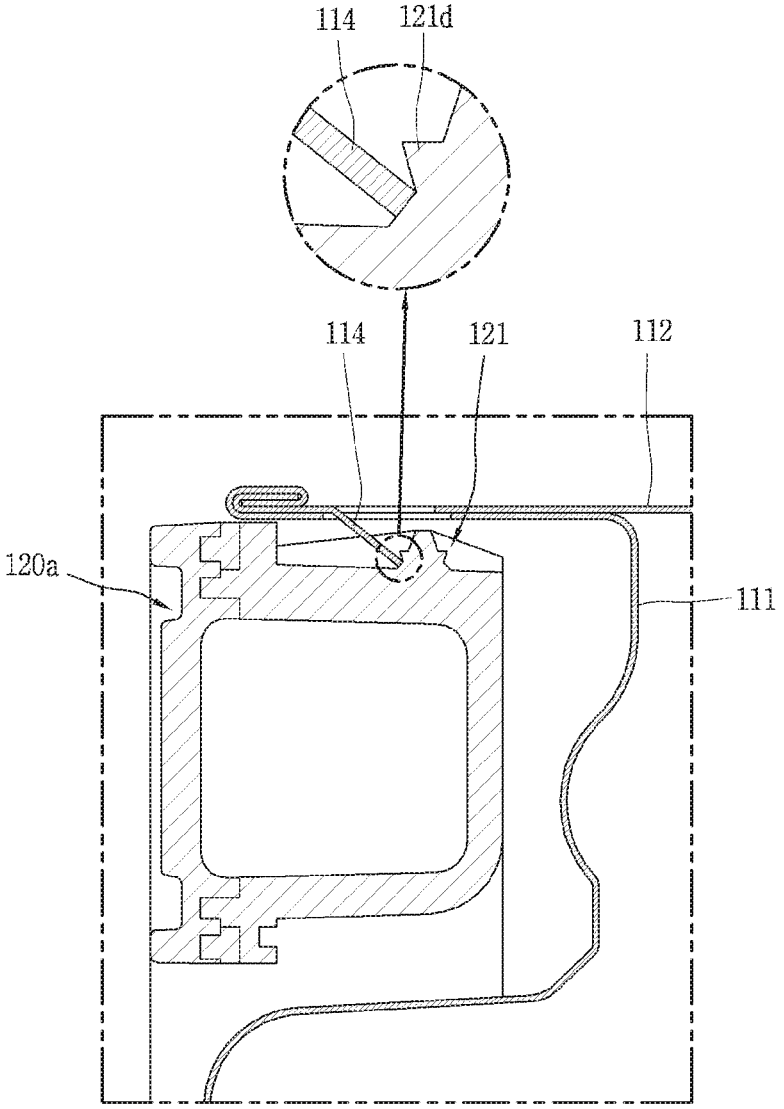
FIG. 8A is a sectional view of a locking tab bent from a front portion of the drum and inserted into the fastener.
Figure 8B:
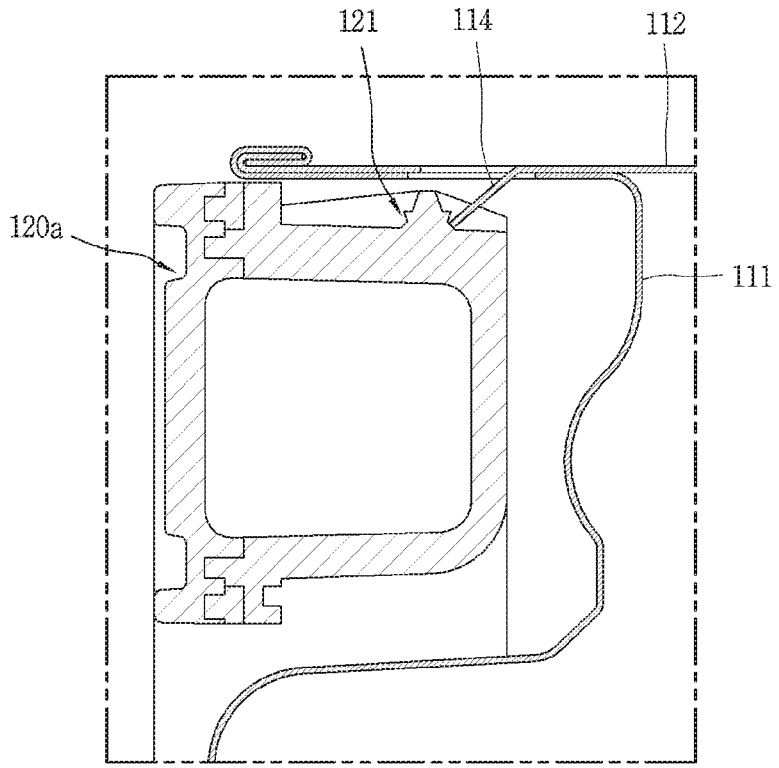
FIG. 8B is a sectional view of the locking tab located at a different position from that illustrated in FIG. 8A and bent from the front portion of the drum, and inserted into the fastener.

Referring to FIG. 8A and FIG. 8B, the locking tab 114 may be accommodated in the fastener 121 at a front portion of the drum 110 such that the drum 110, formed by the drum cylinder 112 and the front member 111, may be coupled with the first balancer 120*a*. The locking tab 114 may be formed by cutting the outer circumferential surface of the drum 110 into a predetermined shape so that an external force may bend the locking tab 114 into the drum 110. The drum 110 may be made of a metal. As illustrated in FIG. 8A, when the outer circumferential surface of the drum 110 is cut, the cut surface may be bendable into the drum 110 due to a characteristic of the metal so as to function as the locking tab 114. The outer circumferential surface of the drum 110 may refer to the outer circumferential surface of the front member 111 and/or the drum cylinder 112.

As illustrated in FIG. 8A, the locking tab 114 may be formed by cutting a portion where the front member 111 and the drum cylinder 112 overlap each other. The locking tab 114 may be formed by the outer circumferential surface of the front member 111 or the outer circumferential surface of the drum cylinder 112. FIG. 8A and FIG. 8B illustrate the locking tab 114 formed by cutting the outer circumferential surface of the drum cylinder 112.

The locking tab 114 may be bent by an external force applied by an operator, and locked or held in place by the stop 121*d* of the fastener 121, so as to restrict movement of the ball balancer 120 in a forward or backward direction of the drum 110. Accordingly, the locking tab 114 may have a preset or prescribed length. The locking tab 114 may be cut to have a length long enough to be locked by the stop 121*d* of the fastener 121.

FIG. 8B illustrates the locking tab 114 formed by cutting the outer circumferential surface of the drum 110 and accommodated in the fastener 121 after being bent by an external force. The locking tab 114 may be formed to be bent in a direction different from that of the locking tab 114 of FIG. 8A in order to be accommodated in the fastener 121. As illustrated in FIG. 8B, a cut location of the outer circumferential surface of the drum 110, different from a cut location of FIG. 8A, may be cut to form the locking tab 114. Accordingly, the locking tab 114 of FIG. 8B may be located at a different position from a position of the locking tab 114 of FIG. 8A. The locking tab 114 in FIG. 8B and the locking tab 114 in FIG. 8A may be formed at positions facing each other based on the balancer 120.

At least one locking tab 114 may be provided, and a plurality of locking tabs 114 may be formed at a predetermined interval along the outer circumference of the drum 110. The locking tabs 114 may be bent alternately in different directions to be supported by the stops 121*d* of the fasteners 121, respectively. The drum 110 and the balancer 120 may be more effectively fixed compared to if the locking tabs 114 are bent in a same direction.

Figure 9A:
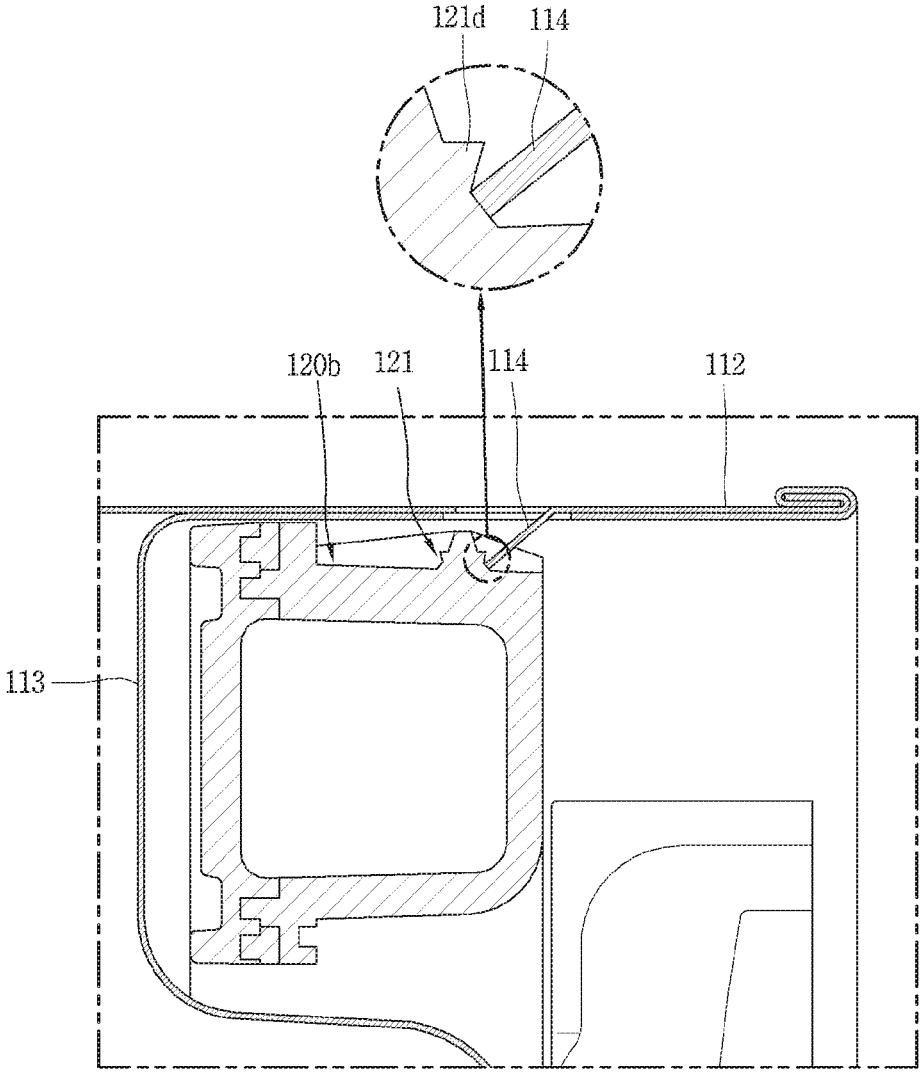
FIG. 9A is a sectional view of the locking tab bent from the rear portion of the drum and inserted into the fastener.
Figure 9B:
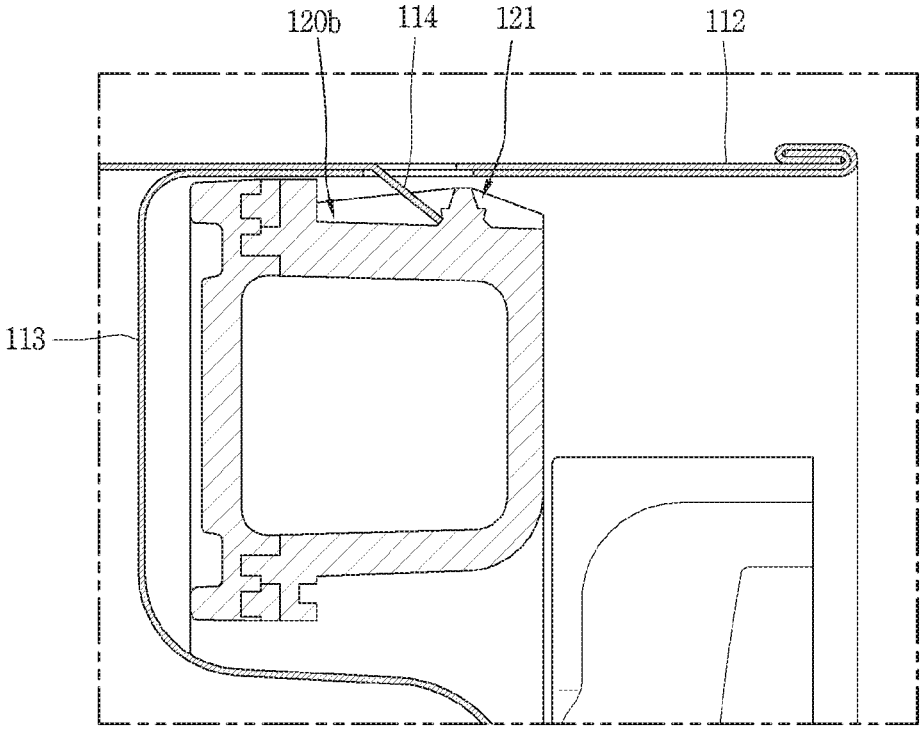
FIG. 9B is a sectional view of the locking tab located at a different position from that illustrated in FIG. 9A and bent from the rear portion of the drum, and inserted into the fastener.

Referring to FIG. 9A and FIG. 9B, the locking tab 114 may be accommodated in the fastener 121 at a rear of the drum 110. Structures illustrated in FIG. 8A and FIG. 8B may equally be applied to the coupling of the drum 110, formed by the drum cylinder 112 and the rear member 113, to the second balancer 120*b*. As illustrated in FIG. 9A and FIG. 9B, the locking tab 114 may be formed by cutting the outer circumferential surface of the drum 110 into a predetermined shape and then bent by an external force.

Since the drum 110 is made of a metal, as illustrated in FIG. 9A, when the outer circumferential surface of the drum 110 is cut, the cut portion may be bendable into or towards the drum 110 due to characteristics of the metal itself. The outer circumferential surface of the drum 110 may refer to the outer surface of the rear member 113 and the drum cylinder 112. As illustrated in FIG. 9A, the locking tab 114 may be formed by cutting a portion where the rear member 113 and the drum cylinder 112 overlap each other. The locking tab 114 may be formed by the outer circumferential surface of the rear member 113 or the outer circumferential surface of the drum cylinder 112. FIG. 9A and FIG. 9B illustrate the outer circumferential surface of the drum cylinder 112 cut to form the locking tab 114.

The locking tab 114 may be bent by an external force applied by an operator, and locked by the stop 121*d* of the fastener 121 so as to restrict the movement of the balancer 120 in the forward or backward direction of the drum 110. Accordingly, the locking tab 114 may have a preset or prescribed length. The locking tab 114 may preferably be cut to have a length long enough to be locked by the stop 121*d* of the fastener 121.

In FIG. 9B, similar to FIG. 9A, the locking tab 114 may be formed by cutting the outer circumferential surface of the drum 110 and may be bent by an external force to be accommodated in the fastener 121. The locking tab 114 may be accommodated in the fastener 121 by being bent in a direction different from that of the locking tab 114 in FIG. 9A. As illustrated in FIG. 9B, a cut location of the outer circumferential surface of the drum 110, which is different from a cut location of FIG. 9A, may be cut to form the locking tab 114. Accordingly, the locking tab 114 of FIG. 9B may be located at a different position from a position of the locking tab 114 of FIG. 9A. The locking tab 114 in FIG. 9B and the locking tab 114 in FIG. 9A may be formed at positions facing each other based on the balancer 120.

The locking tabs 114 may be formed at predetermined intervals along the outer circumference of the drum 110. The locking tabs 114 may be bent alternately in different directions to be supported or locked by the stops 121*d* of the fasteners 121, respectively. The drum 110 and the balancer 120 may be more effectively fixed as compared to if the locking tabs 114 are bent in the same direction.

Figure 10:
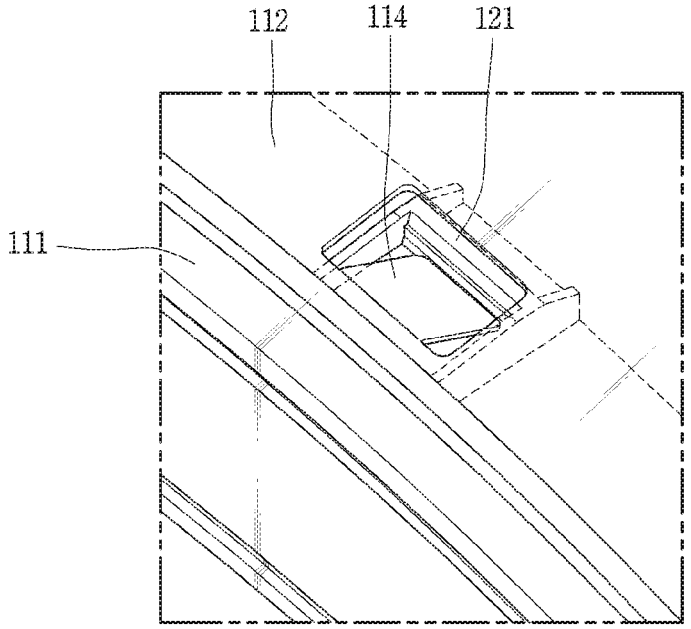
FIG. 10 is a view of a locking tab cut into a rectangular shape and inserted into the fastener.

FIG. 10 illustrates the locking tab 114, which may be cut into a rectangular shape, accommodated or held in place in the fastener 121. The locking tab 114 may be accommodated in the fastener 121 by being bent by an external force.

The locking tab 114 may be formed by cutting a portion of the outer circumferential surface of the drum 110 into a rectangular shape. Each corner may be rounded. A width of the locking tab 114 may correspond to a width of the fastener 121. The width of the locking tab 114 may be decided by a length of the third portion 121*c* of the fastener 121 and the separation of the locking tab 114 may be prevented by the first portion 121*a* and the second portion 121*b* located at both ends of the third portion 121*c* as well as the stop 121*d*.

The locking tab 114, which may be cut into the rectangular shape except for one edge, may be bent in a direction towards a center of the drum 110 from the uncut edge. The bent locking tab 114 may be supported or locked in place by the stop 121*d* of the fastener 121, thereby fixing the drum 110 and the balancer 120 to each other.

Figure 11:
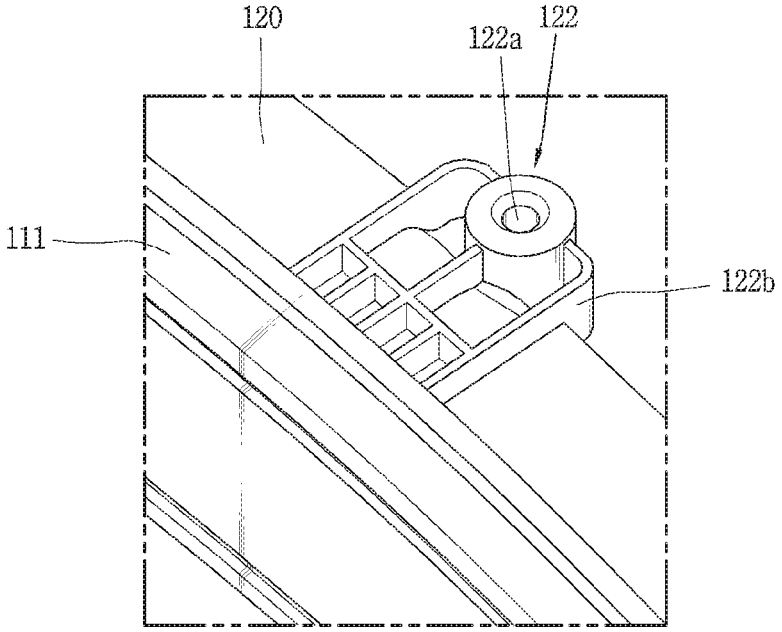
FIG. 11 is a perspective view of a screw mount formed on the balancer.

Referring to FIG. 11, at least one screw mount 122 may be formed on the balancer 120. A plurality of screw mounts 122 may be formed at predetermined intervals along the outer circumferential surface of the balancer 120. The fasteners 121 or the screw mounts 122 may be alternately arranged on the outer circumferential surface of the balancer 120 at predetermined intervals. The fastener 121 for the locking tab 114, formed by cutting the outer circumferential surface of the drum 110, and the screw mount 122, into which a screw may be inserted, may be formed on the outer circumferential surface of the balancer 120 at predetermined intervals. The screw mounts 122 may be formed at the outer circumferential surface of the drum 100 so as to correspond to the holes 115, through which the screws may be inserted, respectively.

Each of the screw mounts 122 may be provided with a screw hole 122*a*. The screw hole 122 may be formed in a cylindrical shape in which a screw may be inserted. Ribs 122*b* may protrude from the outer circumferential surface of the balancer 120 and may be connected to the screw hole 122*a*. The ribs 122*b* may be connected to both sides of the screw hole 122*a* and may contact with an inner circumferential surface of the drum 110. The rib 122*b* may support the inner circumferential surface of the drum 110. Each rib 122*b* may extend along one direction and be bent in a direction different from the one direction. Thus, a space may be formed between the ribs 122*b*.

Figure 12:
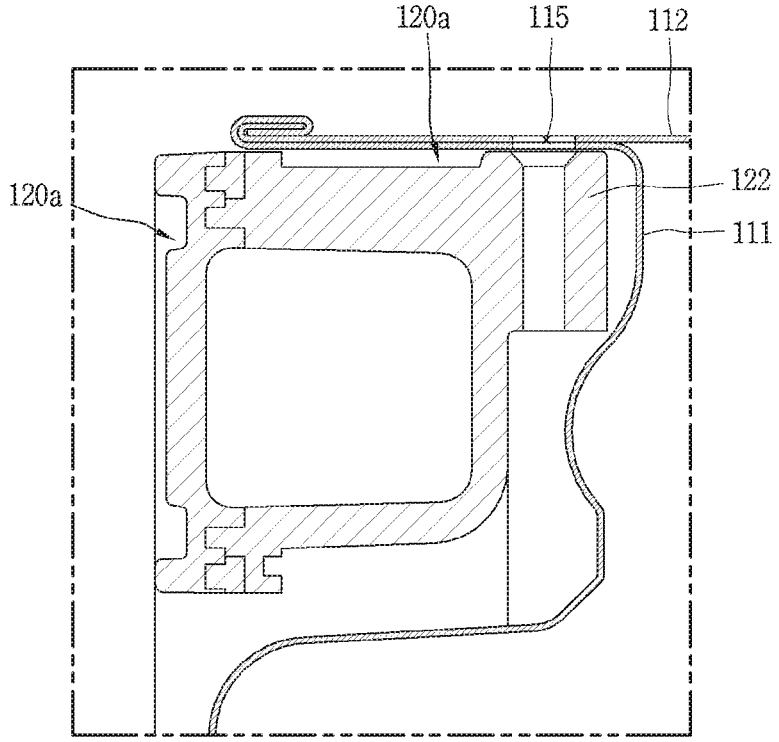
FIG. 12 is a sectional view of a front balancer and a front member of the drum coupled via a screw.
Figure 13:
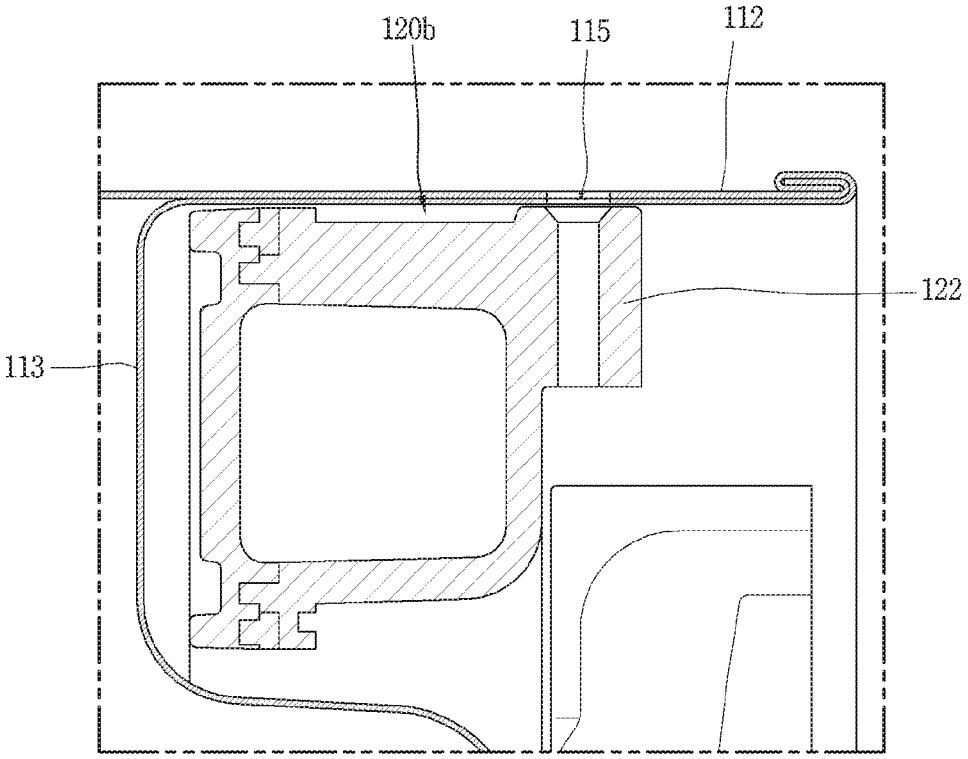
FIG. 13 is a sectional view of a rear balancer and a rear member of the drum coupled via a screw.

Referring to FIG. 12, the first balancer 120*a* and the front member 111 of the drum 110 may be coupled to each other by a screw through the hole 115 and in the screw mount 122. Referring to FIG. 13, the second balancer 120*b* and the rear member 113 of the drum 110 may be coupled to each other by a screw through the hole 115 and in the screw mount 122. The first balancer 120*a* and the second balancer 120*b* may be located in spaces formed where the front and rear members 111 and 113 of the drum 110 protrude, respectively.

The hole 115 formed through the outer circumferential surface of the drum 110 may be provided in plurality, and a plurality of holes 115 may be spaced apart from one another along the outer circumferential surface of the drum 110. The screw mount 122 formed on the outer circumferential surfaces of the first balancer 120*a* and the second balancer 120*b* may be provided in plurality, and the plurality of screw mounts 122 may be spaced apart from one another along the outer circumferential surfaces of the first balancer 120*a* and the second balancer 120*b*.

The screw mounts 122 formed on the outer circumferential surfaces of the first balancer 120*a* and the second balancer 120*b* and the holes 115 formed on the outer circumferential surface of the drum 110 may be located to overlap or correspond to each other. The drum 110 and the balancer 120 may be coupled to each other by via a screw into the screw hole 122*a*. Accordingly, the movement of the balancer 120 in the back-and-forth direction due to the rotation of the drum 110 during a washing process may be prevented.

Fixing the balancer 120 and the drum 110 to each other through the screw coupling may take more time than bending the locking tab 114 on the outer circumferential surface of the drum 110 into the fastener 121 of the balancer 120. Therefore, by appropriately arranging locations for the screw mounts 122 and fasteners 121, as in the present disclosure, manufacturing time may be be effectively reduced even while providing a same coupling force, as compared with fixing the drum 110 and the balancer 120 by using just screws. The clothes processing apparatus described above is not limited to the configurations and the methods of the embodiments described above, but the embodiments may be configured by selectively combining all or some of the embodiments so that various modifications may be made.

Embodiments disclosed herein may provide an apparatus capable of fixing a balancer and a drum in a simple manner and applying a same coupling force as screw coupling. Embodiments disclosed herein may also prevent a back-and-forth movement of a balancer as a drum rotates, by way of fixing the drum and the balancer to each other.

Embodiments disclosed herein may provide operator convenience by fixing a drum and a balancer to each other by inserting or pushing a cut surface of the drum into the balancer. Embodiments disclosed herein may also provide a way to quickly couple a drum and a balancer to each other by fixing the drum and the ball balancer to each other in a lock-coupling manner rather than just a screw-coupling manner.

According to embodiments disclosed herein, a clothes treating apparatus may include a drum having a hook or locking tab formed by cutting an outer circumferential surface thereof to be bent inwardly by an external force, and a balancer having a fastener protruding from the outer circumferential surface to accommodate the locking tab therein, wherein the locking tab is bent to be closely adhered on or attached to the fastener, and restricts a movement of the balancer in a forward or backward direction of the drum due to a rotation of the drum.

The drum may be provided with a through hole formed through the outer circumferential surface, so that a screw is insertable therein, and the locking tab and the through hole may be alternately arranged along the outer circumferential surface of the drum at a preset interval. The locking tab may be formed by cutting the outer circumferential surface of the drum into a rectangular shape, and bent in a direction intersecting with a rotating shaft of the drum based on one edge.

The locking tab may have a preset length to be accommodated in the fastener and supported by being closely adhered on the balancer. The locking tab may be provided in plurality on the outer circumferential surface of the drum at preset or prescribed intervals. The plurality of locking tabs may be bent in different directions to be alternately accommodated in the fasteners.

The balancer may be provided with a screw mount at a position corresponding to the through hole along the outer circumferential surface of the drum, such that a screw is insertable therein. The fastener may have an inside in a tapered shape such that the locking tab bent by an external force is inserted therein and supported.

The fastener may include a first portion protruding from an outer circumferential surface of the balancer and extending in a direction parallel to the rotating shaft of the drum, so as to prevent a separation of the locking tab, a second portion protruding from the outer circumferential surface of the balancer and spaced by a preset distance from the first portion to face each other, and a third portion connected to the first portion and the second portion, and protruding from the outer circumferential surface of the balancer in an intersecting direction with an extending direction of the first and second portions, so as to support the locking tab. The third portion may be provided with a stop formed in a shape of a slit inwardly formed along a central portion, so as to prevent a separation of the bent locking tab.

According to embodiments disclosed herein, a clothes treating apparatus may include a drum, a first balancer provided along a front end of the drum to balance a load of the drum, a second balancer provided along a rear end of the drum to balance the load of the drum, a plurality of locking plates or tabs formed by cutting a portion of an outer circumferential surface of the drum to be bendable inward towards an interior of the drum, and a plurality of fasteners that protrudes from an outer circumferential surface of the first balancer and the second balancer to hold the fastener. Each of the plurality of locking tabs may be configured to be bent inward towards the interior of the drum in order to be locked in each of the respective plurality of fasteners so as to restrict movement of the first balancer and the second balancer due to rotation of the drum.

According to embodiments disclosed herein, a locking tab to fix a balancer to a drum in a washing machine may include a hook portion formed by cutting a portion of an outer circumferential surface of the drum, a hook accommodating portion provided along an outer circumferential surface of the balancer. The hook portion may be bent and fit under a notch provided on the hook accommodating portion in order to lock the hook portion into place.

According to the present disclosure, the drum and the balancer may be fixed to each other in a manner of simply pressing the locking tab formed on the outer circumferential surface of the drum into the fastener. By fixing the locking tab of the drum into the fastener of the balancer, a same coupling force as that provided via screw-coupling may be provided.

The locking tab of the drum may be provided in plurality located in different directions and inserted into the fasteners, respectively, thereby preventing a movement of the balancer in a forward or backward direction of the drum, irrespective of a rotation of the drum. Also, the locking tab of the drum may be pushed into the fastener of the balancer, which may allow an operator to quickly fix the drum and the balancer to each other. This coupling method may be performed by the operator faster than a coupling method merely using screws, thereby improving productivity.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a drum;

a plurality of locking tabs, each of the locking tabs formed by cutting a portion of an outer circumferential wall of the drum to be bent inward towards an interior of the drum;

a balancer; and a plurality of fasteners that protrude from an outer circumferential surface of the balancer to hold the locking tabs, wherein the locking tabs are configured to be locked in the fasteners and to restrict movement of the balancer in a forward or backward direction of the drum as the drum rotates, wherein first locking tabs of the plurality of locking tabs are bent inwards such that the first locking tabs extend towards a front end of the drum, and second locking tabs of the plurality of locking tabs are bent inwards such that the second locking tabs extend towards a rear end of the drum, wherein the first locking tabs and the second locking tabs are alternatively provided at a prescribed interval along the outer circumferential wall of the drum, wherein one of the fasteners includes stops formed in a shape of a ridge outwardly formed along a central portion thereof so as to prevent a separation of a corresponding one of the locking tabs from the one of the fasteners, and wherein one of the stops extends toward the rear end of the drum, and another one of the stops extends toward the front end of the drum.

2. The apparatus of claim 1, wherein the drum is provided with a hole formed in the outer circumferential wall of the drum at a position spaced apart from the fasteners, so that a screw is insertable therein.

3. The apparatus of claim 1, wherein each of the locking tabs is formed by cutting the portion of the outer circumferential wall of the drum into a rectangular shape and bending the cut portion along one edge of the rectangular shape, and wherein the one edge extends in a direction parallel to an edge of the drum.

4. The apparatus of claim 1, wherein each of the locking tabs has a prescribed length to be accommodated in a corresponding one of the fasteners.

5. The apparatus of claim 2, wherein the balancer is provided with a screw mount at a position corresponding to the hole along the outer circumferential wall of the drum, such that the screw is insertable therein.

6. The apparatus of claim 1, wherein each of the fasteners has a tapered shape such that a corresponding locking tab of the plurality of locking tabs bent by an external force is inserted therein and held in place.

7. The apparatus of claim 1, wherein at least one of the fasteners includes:

a first portion that protrudes from the outer circumferential surface of the balancer and extends in a direction parallel to a rotating axis of the drum;

a second portion that protrudes from the outer circumferential surface of the balancer and is spaced by a prescribed distance from the first portion to face the first portion; and a third portion that connects the first portion and the second portion, and protrudes from the outer circumferential surface of the balancer perpendicular to an extending direction of the first and second portions so as to lock a corresponding one of the locking tabs.

8. The apparatus of claim 7, wherein the third portion is provided with at least one of the stops along a central portion of the third portion, so as to prevent a separation of the corresponding locking tab.

9. A clothes treating apparatus, comprising:

a drum;

a first balancer provided along a front end of the drum to balance a load of the drum;

a second balancer provided along a rear end of the drum to balance the load of the drum;

a plurality of locking tabs formed by cutting a portion of an outer circumferential wall of the drum to be bent inward towards an interior of the drum; and a plurality of fasteners that protrudes from an outer circumferential surface of the first balancer and an outer circumferential surface of the second balancer to hold the plurality of locking tabs, wherein each of the plurality of locking tabs is configured to be locked in a corresponding one the respective plurality of fasteners so as to restrict movement of the first balancer and the second balancer due to rotation of the drum, wherein first locking tabs of the plurality of locking tabs are bent inwards such that the first locking tabs extend towards the front end, and second tabs of the plurality of locking tabs are bent inwards such that the second locking tabs extend towards the rear end, wherein the first locking tabs and the second locking tabs are alternately provided at a prescribed interval along the outer circumferential wall of the drum, and wherein one of the fasteners includes stops formed in a shape of a ridge extending outwardly along a central portion thereof, so as to prevent a separation of a corresponding one of the locking tabs from the one of the fasteners, wherein one of the stops extends toward the rear end of the drum, and another one of the stops extends toward the front end of the drum.

10. The apparatus of claim 9, wherein each of the plurality of fasteners includes:

a first portion that protrudes from one of the outer circumferential surface of the first balancer or the outer circumferential surface of the second balancer and extends in a direction parallel to a rotating axis of the drum;

a second portion that protrudes from the one of the outer circumferential surface of the first balancer or the outer circumferential surface of the second balancer and is spaced by a prescribed distance from the first portion to face the first portion; and a third portion that is connected to the first portion and the second portion, and protrudes from the one of the outer circumferential surface of the first balancer or the outer circumferential surface of the second balancer perpendicular to an extending direction of the first and second portions.

11. The apparatus of claim 10, wherein the third portion includes at least one of the stops, and the at least one of the stops is configured to hold and lock an end of the corresponding one of the plurality of locking tabs.

12. The apparatus of claim 9, further including:

a plurality of holes provided along the outer circumferential wall of the drum;

a plurality of screw mounts provided along the outer circumferential surface of the first balancer and the outer circumferential surface of the second balancer to correspond to locations of the plurality of holes such that a screw inserted through each of the plurality of holes and respective plurality of screw mounts fix the first balancer and second balancer to the drum.

13. The apparatus of claim 12, wherein the plurality of screw mounts are provided to alternate with the plurality of fasteners along the outer circumferential surface of the first balancer and the outer circumferential surface of the second balancer.

14. The apparatus of claim 9, wherein the first balancer and the second balancer include balls inside to balance the load of the drum.

15. The apparatus of claim 9, wherein the first balancer and the second balancer are filled with fluid to balance the load of the drum.

16. A clothes treating apparatus, comprising:

a drum having a front end with an opening to receive laundry, a rear end, and a cylinder extending between the front end and the rear end;

a balancer provided at one of the front end or the rear end;

a plurality of tabs provided on the cylinder at the one of the front end or the rear end, the plurality of tabs including first tabs that protrude toward into an interior of the cylinder and extend towards the front end, and second tabs that protrude toward into the interior of the cylinder and extend towards the rear end; and a plurality of fasteners that protrude from an outer circumferential surface of the balancer to contact the tabs to couple the balancer to the drum, wherein one of the fasteners includes:

first and second walls that are spaced apart and are provided on the outer circumferential surface of the balancer to extend along an axial direction of the drum, and a third wall provided on the outer circumferential surface of the balancer to extend between the first wall and the second portion wall along a circumferential direction of the drum, wherein the third wall includes a ridge that is outwardly formed along a central portion thereof so as to prevent a separation of a corresponding one of the tabs from the fasteners, and wherein the ridge extends toward the rear end of the drum, and the third wall further includes another ridge that extends toward the front end of the drum.

17. The clothes treating apparatus of claim 16, wherein the balancer is a first balancer provided at the front end, the fasteners are first fasteners that contact a first set of the first and second tabs that extend through openings in the front end, and wherein the clothes treating apparatus further comprises:

a second balancer provided at the rear end; and a plurality of second fasteners that protrude from an outer circumferential surface of the second balancer to contact a second set of the first and second tabs that extend through openings in the rear end.

18. The clothes treating apparatus of claim 16, further including:

a plurality of holes provided along the cylinder of the drum;

a plurality of screw mounts provided along the outer circumferential surface of the balancer to correspond to locations of the plurality of holes such that screws inserted through the plurality of holes and plurality of screw mounts fix the balancer to the drum, wherein the plurality of screw mounts alternate with the plurality of fasteners along the outer circumferential surface of the balancer.

* * * * *